United States Patent [19]

Gömann et al.

[11] Patent Number: 4,825,994

[45] Date of Patent: May 2, 1989

[54] APPARATUS FOR TRANSPORTING AND REMOVING SAMPLES FROM A STREAM OF CIGARETTES OR THE LIKE

[75] Inventors: Rolf Gömann, Dassendorf; Karl-Heinz Schlüter; Günther Menge, both of Hamburg, all of Fed. Rep. of Germany

[73] Assignee: Körber AG, Hamburg, Fed. Rep. of Germany

[21] Appl. No.: 414,319

[22] Filed: Sep. 2, 1982

[30] Foreign Application Priority Data

Sep. 19, 1981 [DE] Fed. Rep. of Germany ..... 3137327

[51] Int. Cl.[4] ..... B65G 47/46

[52] U.S. Cl. ..... 198/370; 198/438; 198/689.1; 131/282

[58] Field of Search ..... 198/370, 438, 689; 131/94, 95, 281, 282, 280

[56] References Cited

U.S. PATENT DOCUMENTS

| | | | |
|---|---|---|---|
| 3,485,357 | 12/1969 | Payne | 198/689 X |
| 3,664,891 | 5/1972 | Schubert et al. | 198/438 X |
| 3,665,930 | 5/1972 | Giatti | 131/94 X |
| 3,685,633 | 8/1972 | Rudszinat et al. | 198/438 |
| 3,782,523 | 1/1974 | Giatti | 198/438 X |
| 4,391,372 | 7/1983 | Calhoun | 198/370 X |
| 4,452,255 | 6/1984 | Brand | 198/438 X |

FOREIGN PATENT DOCUMENTS 1657235 1/1968 Fed. Rep. of Germany .

*Primary Examiner*—Robert J. Spar
*Assistant Examiner*—Lyle K. Kimms
*Attorney, Agent, or Firm*—Peter K. Kontler

[57] ABSTRACT

Apparatus for removing samples from a single-layer stream of cigarettes which move sideways in the peripheral flutes of hollow rotary first and second drum-shaped conveyors has two valving elements which are disposed in the interior of the respective conveyors and establish or terminate connections between certain suction ports of the two conveyors and a suction generating device in such a way that a desired number of samples can remain on the first conveyor and advance therewith beyond a transfer zone between the two conveyors when the operator depresses a pushbutton, or at regular intervals. In normal operation, all of the cigarettes which are supplied to the flutes of the first conveyor upstream of the transfer zone are delivered to the flutes of the second conveyor. When the operator generates a signal which initiates the removal of samples, suction ports in a selected portion of the periphery of the first conveyor are connected with the suction generating device whereas the suction ports in a selected portion of the periphery of the second conveyor are disconnected from such source. Therefore, when such portions of the peripheries of the two conveyors meet in the transfer zone, the cigarettes which are attracted by the suction ports in the selected portion of the first conveyor remain in the respective flutes and are transported to a removing location where they enter a container. Except in the selected portions of the peripheries of the two conveyors, the suction ports from pairs of spaced parallel rows, and the suction ports in such selected portions form single rows which are disposed between the respective pairs of rows.

23 Claims, 3 Drawing Sheets

APPARATUS FOR TRANSPORTING AND REMOVING SAMPLES FROM A STREAM OF CIGARETTES OR THE LIKE

BACKGROUND OF THE INVENTION

The present invention relates to apparatus for transporting rod shaped articles, especially plain or filter tipped cigarettes, cigars, cigarillos, filter rod sections and/or other articles which constitute or form part of smokers' products. For the sake of convenience, the following description will refer to the transport of rod-shaped articles which constitute or form part of smokers' products with the understanding, however, that the same technique can be resorted to for the transport of other types of rod-shaped commodities.

It is often necessary to transport plain or filter cigarettes or analogous rod-shaped articles (hereinafter called articles) at right angles to their axes (sideways) along a composite path which extends in part along a first and in part along a second conveyor. For example, filter cigarettes in a tipping machine are normally transported in the form of a single-layer stream whose constituents are caused to move through severing, inverting, drying, testing, ejecting and/or other stations. As a rule, the conveyors are rotary drums or endless belts or chains which are formed with axially parallel peripheral flutes and have suction ports which extend inwardly from the flutes and are connected or connectable with suitable suction generating means to ensure reliable retention of articles during travel along certain portions of the paths which are defined by the conveyors. The suction ports in the peripheral surfaces of the circulating conveyors form predetermined patterns or groups of suction ports in order to ensure that they can be readily connected with the suction generating means during selected stages of angular movement of the respective conveyors. For example, a first conveyor can accept successive articles of a single-layer stream at the five o'clock position to transport the articles to the twelve o'clock position where the articles are accepted by a second conveyor (at the six o'clock position of the second conveyor) which transports them through a predetermined angle, e.g., to the two o'clock position.

It is often desirable or necessary to remove samples from a moving stream of cigarettes or analogous rod-shaped articles, e.g., for the purpose of inspecting the imprints on their wrappers, to weigh the cigarettes in order to ascertain whether or not the mass of tobacco therein meets the requirements which are set by the manufacturers and/or by the authorities, to subject the removed articles to additional tests other than those which can be and/or are normally carried out in the machine proper, to compare a freshly removed batch of articles with the articles that were removed before, and/or for other purposes. Removal of samples presents no problems when the machine is running slowly or when the machine discharges articles into a resevoir or the like. However, removal of samples at regular or irregular intervals is much more problematic when the articles are transported in a modern high-speed machine, e.g., in or from a cigarette maker which turns out up to and in excess of 7000 cigarettes per minute. In such machines, removal of samples by hand is evidently impossible so that, if samples are to be removed, the machine must be specially designed with a view to allow for removal of samples at desired intervals. This entails additional expenditures which contribute significantly to the bulk, cost and complexity of the machine. For example, German Offenlegungsschrift No. 1,657,235 proposes to install a suction drum next to the conveyor which transports the articles along their normal path. The suction drum has suction ports which attract the oncoming articles when connected to a suction generating device so that the suction drum then removes a certain number of articles from their normal path. The normal path is defined by a belt conveyor having flutes which receive the articles from a preceding conveyor and whereon the articles are also held by suction. A drawback of such machines is that the removal of samples from a stream of articles necessitates the provision of an additional conveyor (suction drum) with appurtenant auxiliary equipment including means for applying suction, means for synchronizing the movements of the suction drum with the adjacent conveyor or conveyors and/or others. Such embodiment is quite expensive, and the suction drum occupies space which is not readily available in a cigarette maker, in a filter tipping machine or in another machine for the manufacture and/or processing of plain or filter cigarettes, cigars, cigarillos, filter rod sections or the like.

OBJECTS AND SUMMARY OF THE INVENTION

An object of the invention is to provide an apparatus which can be installed in a maker or processor of cigarettes or analogous rod-shaped articles and which can remove samples from a continuous stream of such articles at desired intervals, in desired numbers and without contributing significantly to the bulk and/or cost of the making and/or processing machine.

Another object of the invention is to provide a sample removing apparatus which can be installed in existing cigarette making, cigarette processing and/or analogous machines as a superior substitute for heretofore known apparatus.

A further object of the invention is to provide an apparatus of the above outlined character which can remove samples from a single-layer stream of rod-shaped articles at a desired frequency by resort to very simple and inexpensive but reliable and long-lasting controls.

An additional object of the invention is to provide an apparatus which is surprisingly simple and inexpensive in spite of its versatility and reliability, and which renders it possible to manipulate and remove samples gently, even when the stream of articles from which the samples are to be removed is transported at a high or very high speed such as is required in modern cigarette making, cigarette processing and analogous machines.

A further object of the invention is to provide an apparatus which can remove samples at the will of the operator or at desired intervals.

Still another object of the invention is to provide a machine which embodies the improved apparatus.

An additional object of the invention is to provide a novel and improved method of removing samples from a continuous or discontinuous stream of rod-shaped articles wherein the articles advance sideways.

A further object of the invention is to provide novel and improved control means for use in an apparatus of the above outlined character.

The invention is embodied in an apparatus for transporting a single layer of at least substantially parallel rod-shaped articles, such as cigarettes, filter rod sections, cigars or cigarillos, substantially at right angles to the longitudinal directions of the articles, i.e., for transporting the articles sideways. The apparatus comprises first and second conveyors which are movable in predetermined directions, which define a transfer zone, and which respectively have first and second patterns of article-attracting suction ports. The conveyors further define an elongated path having first and second sections which are respectively provided on the first and second conveyors and respectively include first and second article-receiving ends that are located, respectively, upstream of and at the transfer zone. The second conveyor is further formed with at least one additional suction port which is machined into or otherwise formed in a predetermined portion of the second conveyor, and the second pattern is interrupted in such predetermined portion of the second conveyor. The apparatus further comprises suction generating means (such suction generating means can constitute a single suction generating device or it may include two or more discrete suction generating devices, e.g., at least one for each conveyor), and control means which is operative to connect or disconnect selected suction ports with and from the suction generating means. The arrangement of the control means is such that the articles are transported from the first into the second section of the path when the ports of the first and second patterns and the additional suction port are connected with the suction generating means during travel along the corresponding sections of the path, and that the articles which are carried by the first conveyor and register with the predetermined portion of the second conveyor in the transfer zone remain on the first conveyor downstream of the transfer zone when the ports of the two patterns are connected with but the additional port is disconnected from the suction generating means, at least while the additional suction port advances in the transfer zone.

In accordance with a presently preferred embodiment of the invention, the first conveyor also includes a predetermined portion having additional suction port means serving to attract the aforementioned remaining articles (i.e., those articles which are not transferred into the second section of the path), at least during travel of the remaining articles past and preferably also during travel of such articles beyond the transfer zone.

The conveyors are preferably endless conveyors which respectively circulate about first and second axes. The additional port of the second conveyor and the additional port means of the first conveyor are preferably staggered with reference to the corresponding patterns of suction ports, as considered in the axial direction of the respective conveyors. For example, the conveyors can constitute rotary drum-shaped conveyors which are rotatable about parallel axes and have axially parallel article-receiving peripheral flutes. The ports of the aforediscussed patterns, the additional port or ports of the second conveyor and the additional port means of the first conveyor communicate with the flutes of the corresponding conveyors. The flutes are machined into the peripheral surfaces of the drum-shaped or analogous conveyors.

Each pattern of suction ports preferably comprises several at least substantially parallel rows of suction ports. The rows are preferably disposed in planes which are at least substantially normal to the axes of the respective conveyors. The additional port means can be disposed between two rows of suction ports in the first conveyor, and the additional port or ports of the second conveyor are preferably disposed between two rows of suction ports in the second conveyor and are staggered with reference to the ports of the rows of ports in the second conveyor, as considered in the direction of movement of the second conveyor.

The additional port means can include a plurality of discrete additional suction ports, and the second conveyor is preferably formed with a plurality of additional suction ports whose number matches the number of additional suction ports in the first conveyor.

The control means can comprise a valving element which is adjacent the first conveyor and has at least one first slot extending along the first section of the path toward and at least close to the transfer zone and communicating with the suction generating means as well as with the ports of the first pattern during travel of such ports along the first section of the path. The valving element is (or can be) further formed with a second slot extending along and beyond the transfer zone and registering with the additional port means while such port means advances along and beyond the transfer zone. The control means then further comprises means for selectively establishing and terminating a communication between the suction generating means and the second slot. The first and second slots preferably overlap each other, as considered in the direction of movement of the first conveyor, upstream of the transfer zone. The second slot has an end portion which is located downstream of the transfer zone but upstream of the receiving end of the first section of the path, as considered in the direction of movement of the first conveyor. The apparatus preferably further comprises a container or other suitable receiving means which is adjacent the end portion of the second slot and serves to accept articles which advance with the first conveyor beyond the transfer zone. The valving element can be further provided with one or more aerating openings disposed downstream of the transfer zone and communicating with the atmosphere as well as with the suction ports of the first pattern while such ports advance beyond the transfer zone to thus ensure that the articles which should be transferred into the second section of the path are indeed accepted by the second conveyor during travel of such articles in the transfer zone.

The control means can comprise a second valving element which is adjacent the second conveyor and has first slot means in communication with the suction generating means and with the suction ports of the second pattern in the second section of the path and in the transfer zone, second slot means adjacent the second section of the path and communicating with the suction generating means as well as with the additional suction port or ports of the second conveyor during travel of such port or ports along the second path section, and third slot means disposed in the transfer zone and communicating with the additional suction port or ports of the second conveyor during travel of such port or ports in the transfer zone. The control means then further comprises means for selectively establishing and terminating a communication between the suction generating means and the third slot means of the second valving element. As mentioned above, the second pattern of suction ports can include first and second rows of ports which are respectively disposed in first and second planes and are at least substantially normal to the axis of the second conveyor; the first slot means can comprise first and second slots which respectively register with the suction ports of the first and second rows constituting the second pattern of suction ports. The first and second slot means of the second valving element can together constitute a composite slot which is connected with the suction generating means.

The control means can comprise regulating means which is actuatable for the application of suction to the additional port means of the first conveyor and for the coordinated termination of the application of suction to the additional suction port or ports of the second conveyor in dependency on the angular positions of the conveyors. The regulating means can comprise means for effecting the establishment and termination of connections between the suction generating means and selected slot or slot means of the two valving elements. Such regulating means can include signal generating means which monitor the angular positions of the conveyors and means (e.g., a suitable memory) for processing the signals which are generated by the monitoring means and for generating additional signals which are used to initiate the application and the termination of application of suction to the additional port means of the first conveyor and to the additional port or ports of the second conveyor. Still further, the apparatus can comprise a pushbutton or other suitable means for activating the regulating means, e.g., when the attendants desire the apparatus to remove a number of samples which are admitted into the aforementioned container that is to accumulate the articles which continue to advance with the first conveyor beyond the transfer zone.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
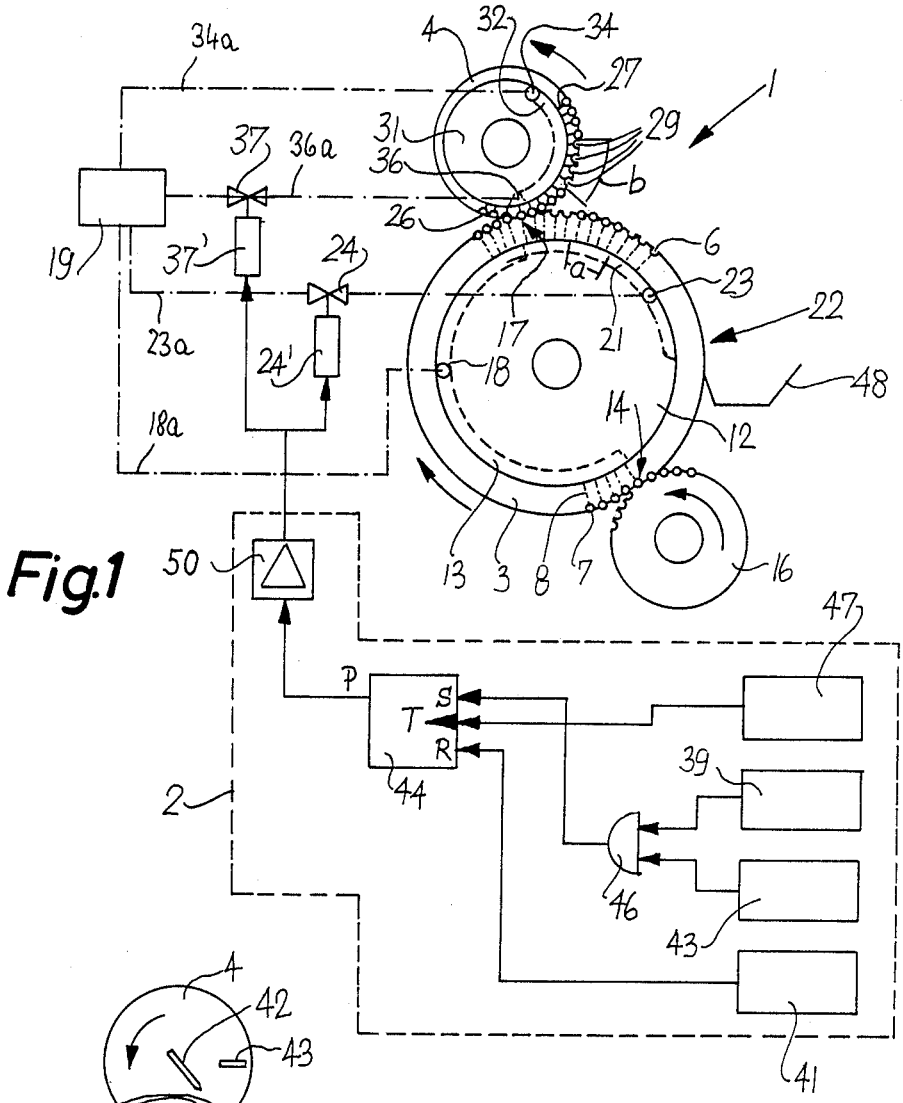
FIG. 1 is a partly diagrammatic end elevational view of a transporting apparatus which embodies one form of the invention.

FIG. 1 illustrates a transporting apparatus 1 which serves to advance a single-layer stream of filter cigarettes 7 or analogous rod-shaped articles of the tobacco processing industry along an elongated path having a first section or stretch which is defined by a first rotary drum-shaped conveyor 3 and a second section or stretch which is defined by a second rotary drum-shaped conveyor 4. The conveyors 3 and 4 rotate about parallel horizontal axes; the means for driving the conveyor 3 in a clockwise direction and for driving the conveyor 4 in a counterclockwise direction, as viewed in FIG. 1, is not specifically shown in the drawing. Such driving means may constitute the main prime mover of a tobacco processing machine, e.g., a filter tipping machine of the type known as MAX or MAX S (manufactured by the assignee of the present application). The transporting apparatus 1 further comprises a suction generating device 19 and a control unit 2 which determines whether all of the cigarettes 7 which are delivered to the first conveyor 3 by an additional rotary drum shaped conveyor 16 upstream of a transfer zone 17 between the conveyors 3, 4 are advanced onto the second conveyor 4, or whether some of the thus delivered cigarettes 7 remain on the first conveyor 3 downstream of the transfer zone 17 and constitute samples which are accumulated in an article-receiving container 48 at a removing location 22. The reference character 14 denotes the receiving end of the first section of the aforementioned elongated path along which the cigarettes 7 normally advance from the conveyor 16 toward a second additional conveyor (not specifically shown) which accepts cigarettes from the conveyor 4 at the discharge end of the second section of the path. The receiving end of the second path section is located at the transfer zone 17 between the conveyors 3 and 4. Cigarettes 7 which are located in the first and/or second section of their path are attracted to the peripheral surfaces of the respective conveyors 3 and 4 by suction. The same holds true for cigarettes 7 which advance with the first conveyor 3 beyond the transfer zone 17 to be deposited in the container 48 at the receiving location 22 which is disposed downstream of the transfer zone 17 but upstream of the additional conveyor 16, as considered in the direction of rotation of the first conveyor.

The conveyor 3 is a hollow cylindrical drum formed with radially extending suction ports 8 which communicate with axially parallel article receiving means in the form of elongated flutes 6 machined into the peripheral surface of the conveyor 3. In their entirety, the ports 8 can be said to constitute a first pattern of suction ports which form two rows 9 and 9′ (see FIG. 3A) extending circumferentially of the conveyor 3 and disposed in two parallel vertical planes which are normal or substantially normal to the axis of the conveyor 3.

The control unit 2 comprises a first stationary cylindrical valving element 12 which is surrounded by the conveyor 3 and serves to establish communication between the suction generating device 19 and the suction ports 8 of the conveyor 3. The peripheral surface of the valving element 12 is formed with a pair of first elongated grooves or slots 13 each of which registers with one of the rows 9, 9′, i.e., each of these slots extends in the circumferential direction of the conveyor 3 and communicates with a certain number of ports 8 in the corresponding row 9 or 9′. The slots 13 extend from the receiving end 14 of the first path section (i.e., from the transfer station between the conveyors 3 and 16) to a location immediately upstream of the transfer zone 17 between the conveyors 3 and 4. One end face of the valving element 12 carries a connecting means in the form of a nipple 18 whose passage communicates with the slots 13 and which is connected with one intake of the suction generating device 19 by a conduit 18*a* (indicated in FIG. 1 by a phantom line).

Figures 3A, 3B:
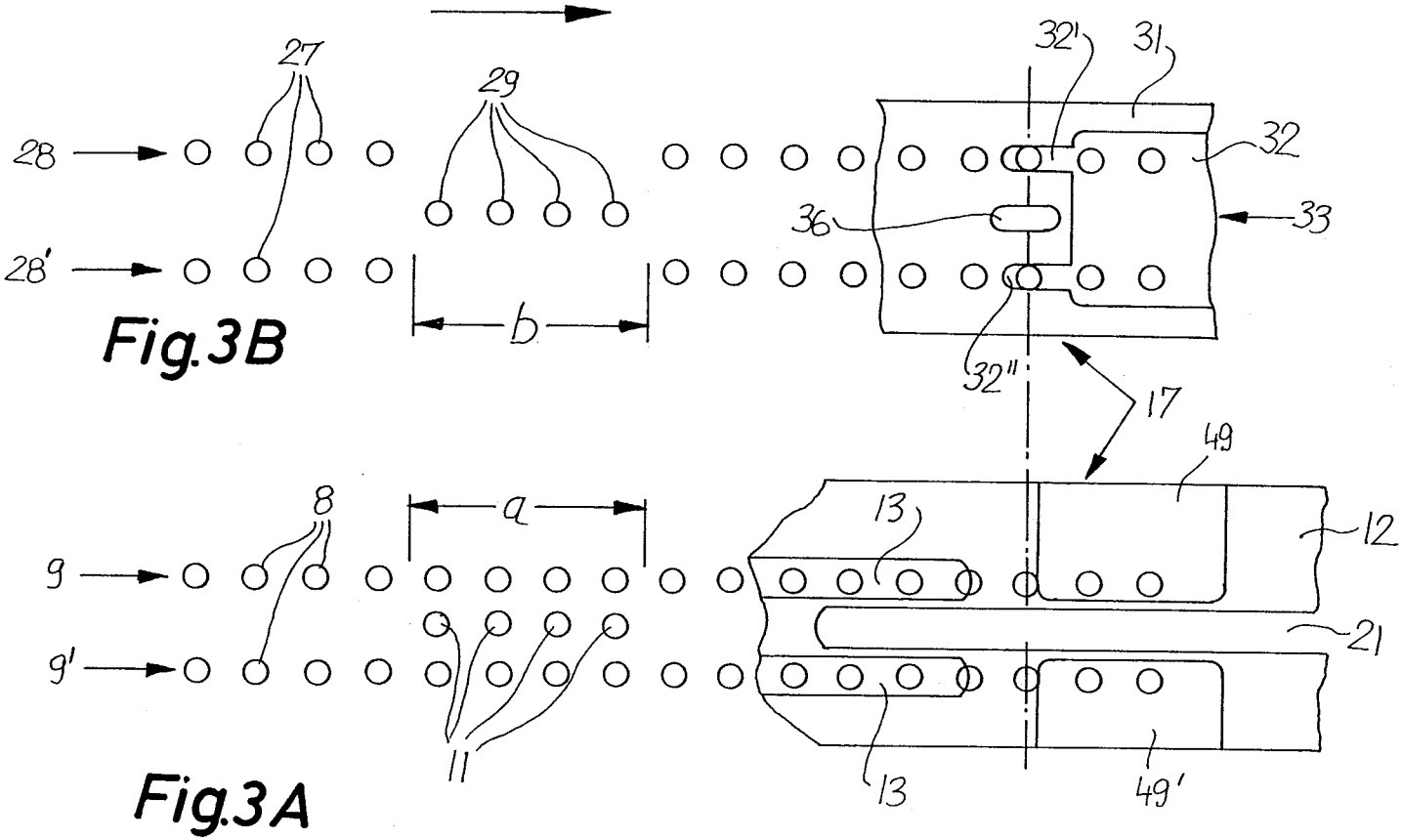
FIG. 3A is a fragmentary developed view of a portion of the first conveyor and of the associated valving element.
FIG. 3B is a similar fragmentary developed view of the second conveyor and of the associated valving element.

As can be seen in FIGS. 1 and 3A, a portion a of the peripheral surface of the conveyor 3 is formed with a set of four additional suction ports 11 which are staggered with reference to the adjacent suction ports 8, as considered in the axial direction of the conveyor 3 and valving element 12. In the illustrated embodiment, the additional suction ports 11 are located between the rows 9 and 9' of suction ports 8 and each thereof is in register with a port 8 of the row 9 as well as with a port 8 of the row 9', as considered in the axial direction of the conveyor 3. The row of four additional suction ports 11 is parallel to the rows 9 and 9', and such additional suction ports communicate with a second slot 21 of the valving element 12 during travel past and beyond the transfer zone 17, namely, during travel from a location slightly ahead of the transfer zone and to the container 48 at the removing location 22. As can be readily seen in FIG. 3A, the front end portion of the slot 21 overlaps the rear ends of the slots 13, as considered in the circumferential direction of the valving element 12. The latter has a second connecting nipple 23 which is disposed at one of its axial ends and communicates with the second slot 21. The nipple 23 is connected with an intake of the suction generating device 19 by a conduit 23*a* which contains a valve 24, e.g., a solenoid-operated valve whose solenoid is shown schematically at 24'. When the valve 24 is open so that the conduit 23*a* can evacuate air from the slot 21 of the valving element 12, the cigarettes 7 in those flutes 6 which communicate with the additional suction ports 11 are transported past the transfer zone 17 and remain on the first conveyor 3 so that they are delivered into the container 48 for samples.

FIG. 3A further shows that the valving element 12 is formed with two aerating openings 49 and 49' which communicate with the atmosphere and with the oncoming suction ports 8 of the respective rows 9 and 9'. This reduces the likelihood of transport (by the conveyor 3) beyond the transfer zone 17 of those cigarettes 7 which are supposed to be transferred onto the second conveyor 4. The openings 49 and 49' begin immediately downstream of the transfer zone 17, as considered in the direction of rotation of the first conveyor 3.

The second conveyor 4 also constitutes a hollow cylindrical body which has axially parallel flutes 26 machined into its peripheral surface and communicating with radially inwardly extending suction ports 27 constituting a second pattern composed of two parallel rows 28 and 28' disposed in planes that are normal to the axis of rotation of the conveyor 4 (see FIG. 3B). The second conveyor 4 surrounds a fixedly mounted second valving element 31 (see FIGS. 1 and 3B) whose peripheral surface is formed with a composite slot 32. The width of the slot 32 downstream of the transfer zone 17 suffices to ensure simultaneous communication with the oncoming suction ports 27 of the two rows 28 and 28'. The reference characters 32' and 32" denote two upstream portions (first slots) of the composite slot 32 which respectively communicate with the oncoming ports 27 of the rows 28 and 28' during travel of such ports along the transfer zone 17. The downstream end of the composite slot 32 is disposed at the location where the cigarettes 7 leave the second section of their path and are accepted by the aforementioned (non-illustrated) second additional conveyor of the processing machine.

In accordance with a feature of the invention, the rows 28 and 28' of the pattern of suction ports 27 in the second conveyor 4 are interrupted in a portion b of the peripheral surface of the conveyor 4. This portion b is formed with a set of four additional suction ports 29 forming a row which is disposed between and is staggered with reference to the rows 28 and 28', as considered in the axial direction of the second conveyor 4 and valving element 31. It will be noted that the number of additional suction ports 11 in the portion a of the peripheral surface of the first conveyor 3 matches the number of additional suction ports 29 in the portion b of the peripheral surface of the second conveyor 4. Once they advance beyond the transfer zone 17, the suction ports 29 communicate with the median or central portion 33 (second slot of the valving element 31) of the composite slot 32 in the valving element 31. In other words, the width of the major part of the slot 32 is selected in such a way that it can simultaneously communicate with the registering ports 27 of the rows 28, 28' as well as with the additional suction ports 29 of the second conveyor 4. One end face of the valving element 31 carries a connecting nipple 34 whose passage communicates with the composite slot 32 and which is connected with an intake of the suction generating device 19 by a conduit 34*a*, i.e., the pressure in the composite slot 32 is always below atmospheric pressure when the apparatus 1 is in use.

It is clear that the relatively wide composite slot 32 of the valving element 31 can be replaced with three discrete slots each of which is permanently connected with the suction generating device 19 or with other suitable suction generating means. In other words, the portions 32' and 32" shown in FIG. 3B can extend all the way from a location upstream of the transfer zone 17 to a location downstream of the transfer zone, namely, to the locus of removal of cigarettes 7 from the second section of their path. In such apparatus, a discrete slot (which replaces the central portion 33 of the slot 32 and constitutes the second slot of the valving element 31) begins immediately or shortly downstream of the transfer zone 17 and extends all the way to the locus of removal of cigarettes 7 from the second conveyor 4. Such discrete slot registers with the additional suction ports 29 during their travel beyond the transfer zone 17 toward the aforementioned locus of removal of cigarettes from the second conveyor 4.

FIG. 3B shows that the valving element 31 is formed with a further (third) slot 36 which is adjacent the transfer zone 17 and communicates with the passage of a connecting nipple (not specifically shown) provided at one axial end of the valving element 31 and connected with an intake of the suction generating device 19 by a conduit 36*a* containing a valve 37 whose solenoid is shown schematically at 37'.

The valves 24 and 37 constitute means for selectively establishing and terminating air-evacuating connections between the suction generating device 19 and the respective slots 21 and 36.

Figure 2:
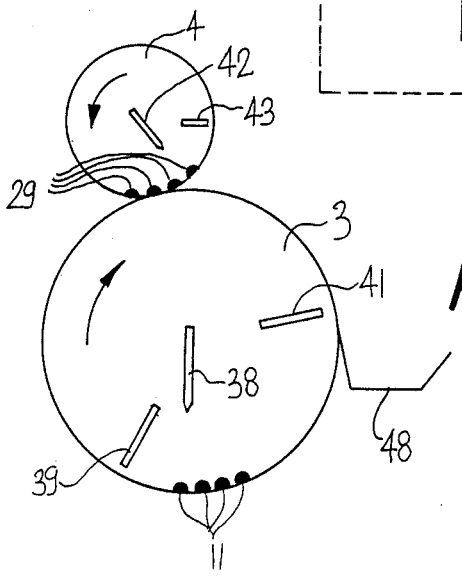
FIG. 2 is a schematic end elevational view of the two conveyors, and further showing the mounting of monitoring means on and with reference to the conveyors.

FIG. 2 illustrates schematically the distribution and orientation of certain component parts in the regulating means of the control unit 2. Such component parts constitute a means for monitoring the angular positions of the conveyors 3 and 4 in order to ensure that the regulation of application, or termination of application, of suction to the additional suction ports 11 in the first conveyor 3 is coordinated with the application, or termination of application, of suction to the additional suction ports 29 in the second conveyor 4. The monitoring means comprise a first signal generator 39 (e.g., a conventional proximity switch) which is adjacent to one end face of the conveyor 3, a second signal generator 43 (e.g., a conventional proximity switch) which is adjacent to one end face of the conveyor 4, a third signal generator 41 (e.g., a conventional proximity switch) adjacent to the one end face of the conveyor 3, a first switch actuator 38 which is rotated by or rotates in synchronism with the conveyor 3, and a second switch actuator 42 which is rotated by or rotates in synchronism with the second conveyor 4. The signal generators 39, 41 and 43 generate and transmit signals when they are approached by the associated actuators 38 and 42, i.e., such signals are generated in predetermined angular positions of the conveyors 3 and 4.

The control unit 2 of FIG. 1 further comprises a signal processing module 44 which constitutes a memory and has a first input S, a second input R, a third input T and an output P. The input S is the setting input of the memory 44 and is connected with the output of a logic circuit here shown as an AND gate 46 whose inputs are connected with the outputs of the signal generators 39 and 43. The resetting input R of the memory 44 is connected with the signal generator 41, and the third (sensitising or activating) input T of the memory 44 is connected with a pushbutton 47 or an analogous activating device which can be depressed or otherwise moved or influenced by hand or by remote control in order to initiate the removal of samples from the single-layer stream of cigarettes 7 which normally advance from the conveyor 16, with the conveyor 3, thereupon with the conveyor 4, and ultimately with the non-illustrated second additional conveyor which is adjacent to the downstream end of the composite slot 32 in the valving element 31. The output P of the memory 44 is connected with the inputs of the solenoids 24' and 37' by a suitable amplifier 50. Solenoids constitute the presently preferred means for opening or closing the valves 24 and 37.

It will be noted that, when the apparatus is not intended to remove samples which are to be deposited in the container 48, the valving element 12 in the first conveyor 3 does not enable the suction ports of the first conveyor 3 to attract cigarettes 7 all the way to and during travel in the transfer zone 17. This is due to the fact that the second slot 21 is then sealed from the suction generating device 19 and that the first slots 13 (which are connected with the suction generating device 19) do not extend all the way to and through the transfer zone 17. On the other hand, the valving element 31 in the second conveyor 4 then ensures that all cigarettes 7 which are delivered to the transfer zone 17 by the first conveyor 3 are invariably transferred onto the second conveyor because the composite slot 32 is connected with the suction generating device 19, the same as the slot 36. The merger of slots 32', 32'' and 33 into a single composite slot 32 contributes to simplicity and reliability of the valving element 31.

The purpose of the aerating openings 49 and 49' in the valving element 12 is to ensure that the pressure in the suction ports 8 of the rows 9 and 9' rises immediately after they reach the transfer zone 17.

The control unit 2 ensures that the removal of samples can be carried out in predictable fashion even if the diameters of the conveyors 3 and 4 are different. This is due to the fact that the actuators and the signal generators of the regulating means shown in FIGS. 1 and 2 ensure that the removal of samples takes place only when the additional suction ports 11 of the first conveyor 3 meet the additional suction ports 29 of the second conveyor 4 at the transfer zone 17.

The operation of the apparatus 1 is as follows:

The conveyor 16 (which is or can also constitute a rotary drum-shaped conveyor having axially parallel peripheral flutes) delivers a cigarette stream consisting of a single layer of parallel cigarettes 7 (which move sideways) to the receiving ends 14 of the slots 13 where successive cigarettes of such stream enter successive peripheral flutes 6 of the first conveyor 3 which rotates in a clockwise direction, as viewed in FIG. 1. The suction generating device 19 is connected with the slots 13 of the valving element 12 by conduit **18*a* and nipple 18 so that the suction ports 8 which form part of the rows 9 and 9' and advance along the respective slots 13 attract the corresponding cigarettes 7 during advancement of such cigarettes along the first section of their path, namely, from the conveyor 16 toward the transfer zone 17 between the conveyors 3 and 4. As mentioned hereinabove and as shown in FIG. 3A, the slots 13 of the valving element 12 terminate immediately upstream of the transfer zone 17, as considered in the direction of rotation of the first conveyor 3**.

The composite slot 32 of the valving element 31 in the second conveyor 4 is also connected with the suction generating device 19 (via conduit **34*a* and nipple 34) so that the suction ports 27 which form part of the rows 28, 28' and reach the transfer zone 17 attract the cigarettes 7 which are delivered by the oncoming flutes 6 of the conveyor 3. This will be readily appreciated since the portions 32' and 32'' of the composite slot 32 in the valving element 31 begin where the slots 13 of the valving element 12 end (compare FIGS. 3A and 3B). The wide portion of the composite slot 32 thereupon ensures that the cigarettes 7 which have been transferred onto the second conveyor 4 in the zone 17 remain in the second section of their path during travel to the non-illustrated second additional conveyor where they leave the corresponding flutes 26** and advance with the second additional conveyor to the next processing station, not shown.

During normal operation of the apparatus 1, the valve 24 in the conduit **23*a* is closed so that the slot 21 of the valving element 12 in the first conveyor 3 is sealed from the suction generating device 19. Thus, the pressure in the additional suction ports 11 which are provided in the portion a of the peripheral surface of the first conveyor 3 matches atmospheric pressure. However, the valve 37 in the conduit 36*a* is normally open so that the slot 36 of the valving element 31 in the second conveyor 4 is connected with the suction generating device 19. Consequently, the additional suction ports 29 which are provided in the second conveyor 4 communicate with the suction generating device 19 as soon as they reach the transfer zone 17, i.e., as soon as they reach the slot 36 of the valving element 31. None of the suction ports (8 and/or 11) in the conveyor 3 which reach the transfer zone 17 are in communication with the suction generating device 19 when the apparatus 1 is in normal use, i.e., when the apparatus is not called upon to remove samples and to deposit such samples in the container 48. Therefore, the additional suction ports 29 which register with the slot 36 of the valving element 31 ensure the transfer of cigarettes 7 from the first conveyor 3 into those flutes 26 of the conveyor 4 which communicate with the additional ports 29. The additional ports 29 thereupon reach the median portion 33 of the composite slot 32 so that they continue to communicate with the suction generating device 19 during their travel along the second section of the path, i.e., toward the location of removal of cigarettes 7 from the periphery of the second conveyor 4**.

If the apparatus 1 is to remove a certain number of samples from the single-layer stream of cigarettes 7 which advance from the first additional conveyor 16 toward the transfer zone 17, an attendant depresses the pushbutton 47 which transmits a signal to the activating or sensitizing input T of the memory 4 in the control unit 2. Thus, the memory 44 is then ready to accept signals which are transmitted by the signal generators 39, 41 and 43. When the actuator 38 advances past the signal generator 39, the latter transmits a signal to the corresponding input of the AND gate 46. At the same time, the signal generator 43 is activated by the element 42 to generate a signal which is transmitted to the other input of the AND gate 46 whose output transmits a signal to the input S of the memory 44. The output P of the memory 44 then transmits a signal to the amplifier 50 which causes the solenoid 24' to open the valve 24 while the solenoid 37' closes the valve 37. It will be noted that the output P of the memory 44 transmits a signal in predetermined angular positions of the conveyors 3 and 4, namely, when the conditions are satisfactory for retention on the conveyor 3 of those cigarettes 7 which are received in the flutes 6 communicating with the additional suction ports 11.

When the valve 24 opens, the slot 21 of the valving element 12 begins to communicate with the suction generating device 19 as soon as the flutes 6 which communicate with the additional suction ports 11 reach predetermined angular positions which are determined by the selected positions of the signal generating devices 39 and 43 with reference to the conveyors 3 and 4. Consequently, when the flutes 6 which communicate with the additional suction ports 11 reach the transfer zone 17, the suction ports 11 already communicate with the suction generating device 19 via slot 21 of the valving element 12 so that the corresponding cigarettes 7 continue to adhere to the first conveyor 3 and are transported toward the removing location 22 to enter the container 48.

When the valve 24 opens, the valve 37 closes so that the slot 36 of the valving element 31 is sealed from the suction generating device 19. Therefore, the additional suction ports 29 of the second conveyor 4 are not acted upon by suction during travel past the transfer zone 17 and the corresponding flutes 26 of the conveyor 4 do not receive cigarettes 7 from the conveyor 3. Therefore, the flutes 6 which communicate with the additional suction ports 11 are free to retain the cigarettes 7 and to advance such cigarettes toward the container 48.

It will be appreciated that the generation of a signal at the output P of the memory 44 merely entails retention on the first conveyor 3 of those cigarettes 7 which are adjacent to the portion a of the peripheral surface of this conveyor. All other cigarettes 7 (i.e., those upstream and downstream of the portion a) are always transferred onto the second conveyor 4 because the composite slot 32 remains connected with the suction generating device 19 irrespective of the setting of the valves 24 and 37. In other words, the transfer of cigarettes 7 from the majority of flutes 6 onto the second conveyor 4 is not affected by the presence or absence of vacuum in the slots 21 and 36.

The actuator 38 which is rotated by or in synchronism with the conveyor 3 reaches the signal generator 41 when the flutes 6 which communicate with the additional suction ports 11 of the first conveyor 3 reach the removing location 22. The signal generator 41 then transmits a signal to the input R of the memory 44 which erases the signal at its output P. The solenoids 24' and 37' are then free to reset the associated valves 24 and 37, i.e., the valve 24 again seals the slot 21 from, and the valve 37 again connects the slot 36 with, the suction generating device 19. This enables the apparatus 1 to resume with the transport of all cigarettes 7 from the conveyor 16, along the first path section on the conveyor 3 and into the second path section on the conveyor 4. In other words, the cigarettes 7 in the flutes 6 which communicate with the additional suction ports 11 of the first conveyor 3 are also transferred onto the second conveyor 4.

The number of cigarettes 7 which are delivered into the container 48 in response to depression of the pushbutton 47 depends on the number of additional suction ports 11 in the portion a of the peripheral surface of the conveyor 3 and on the number of additional suction ports 29 in the portion b of the peripheral surface of the conveyor 4. The frequency of removal of samples during each revolution of the conveyor 3 can be varied by increasing the number of predetermined portions a of the peripheral surface of the conveyor 3 to two or more and/or by changing the ratio of the circumferential lengths of the conveyors 3 and 4.

It is further within the purview of the invention to replace the pushbutton 47 with a device which automatically initiates the activation of the memory 44 at desired intervals, e.g., which ensures the removal of a given number of samples per unit of time or during another interval (such as a shift). All that is necessary is to replace the pushbutton 47 with a device which can apply to the input T of the memory 44 a potential such as is needed to activate the memory until the signal generator 41 transmits a signal to the input R. It is also possible to provide an automatic depressing or activating device for the pushbutton 47. The signal generator 41 can be omitted if the pushbutton 47 is actuated at regular intervals or is replaced by a frequency-selecting device, i.e., the removal of samples then takes place regularly at times determined by the signal generators 39 and 43 which ensure that the changes in condition of the valves 24 and 37 take place when the circumstances are satisfactory for retention of a selected number of cigarettes 7 on the conveyor 3. Thus, the removal of samples can take place regularly whenever the additional suction slots 11 meet the additional suction slots 29 in the transfer zone 17 between the conveyors 3 and 4. The frequency of removal of samples is then dependent exclusively on the ratio of the diameters of the conveyors 3 and 4.

An important advantage of the improved apparatus is that the slot 21 of the valving element 12 can be connected to, and the slot 36 of the valving element 31 can be disconnected from, the suction generating device 19 well ahead of the time when the additional suction ports 11 and 29 reach the transfer zone 17. In other words, the operation of the improved apparatus is not affected by the speed at which the cigarettes 7 are transported by the conveyors 3 and 4 so that such apparatus can be used with advantage in modern high-speed filter tipping, filter rod making, cigarette making, cigar making or analogous machines to ensure predictable removal of selected numbers of rod-shaped articles at regular or irregular intervals.

Figure 3C:
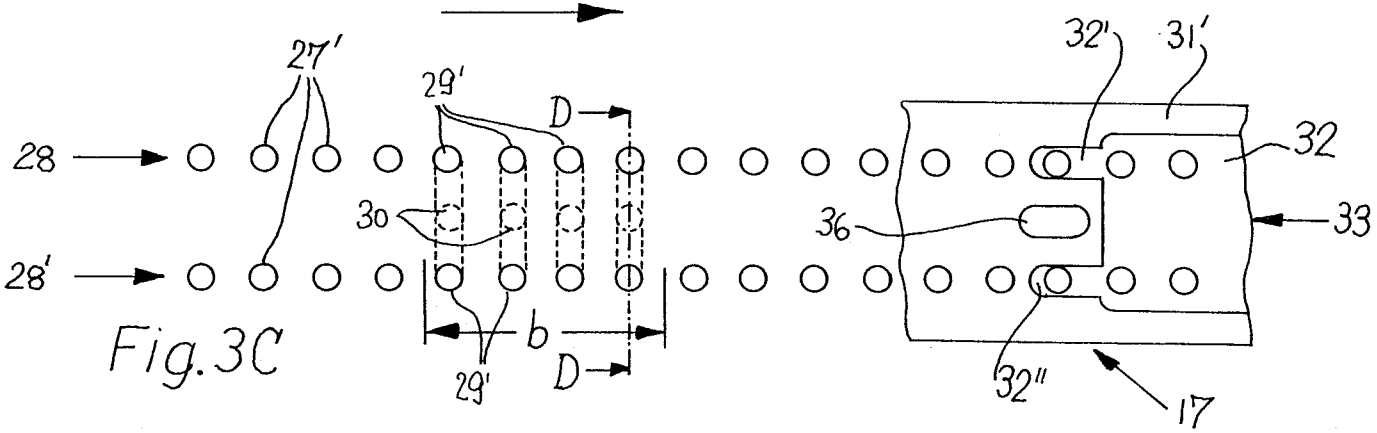
FIG. 3C is a fragmentary developed view of the second conveyor and of a modified valving element which cooperates with the second conveyor.
Figure 3D:
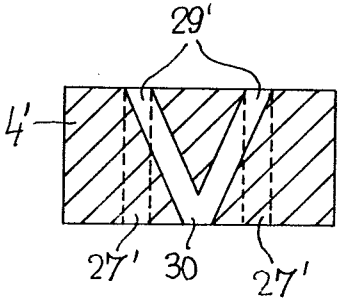
FIG. 3D is a sectional view substantially as seen in the direction of arrows from the line D—D of FIG. 3C.

FIGS. 3C and 3D illustrate a modified pattern of suction ports 27′ in the second conveyor 4′. Such ports again form two parallel rows 28 and 28′ disposed in planes which are normal to the axis of rotation of the second conveyor 4′. The ports 27′ in the portion b of peripheral surface of the second conveyor 4′ can be said to constitute additional suction ports (denoted by the characters 29′) even though their outer ends are not or need not be staggered with reference to the remaining ports 27′, as considered in the axial direction of the second conveyor 4′ and the associated valving element 31′. As shown in FIG. 3D, the ports 29′ are parallel to the ports 27′ but make acute angles therewith so as to communicate with four individual additional ports 30 at the inner side of the second conveyor 4′ which are axially staggered with reference to the ports 27′ upstream and downstream of the portion b. The individual ports 30 (four in number, i.e., one for each pair of axially aligned ports 29′ in the portion b of the peripheral surface of the conveyor 4′) communicate seriatim with the slot 36 of the valving element 31′ during travel along the transfer zone 17 to thereupon communicate with the median or central portion 33 of the composite slot 32 during travel from a locus immediately downstream of the zone 17 and all the way to the locus of removal of articles from the second conveyor 4′. The manner in which the slots 32 and 36 of the valving element 31′ shown in FIG. 3C are connected or connectable with the suction generating device 19 or with analogous suction generating means is preferably the same as described in connection with FIGS. 1 and 3B.

An important advantage of the improved apparatus is that desired numbers of samples can be removed from a continuous or discontinuous stream of rod-shaped articles in response to depression of a pushbutton (47) or at regular intervals, that the number of removed samples is predictable, that the samples are removed gently and without interfering with normal transport of the majority of articles, and that the samples can be gathered at a selected location where they are readily accessible. Removal of samples takes place when the additional suction ports of the first conveyor register with or meet the additional suction ports of the second conveyor in the transfer zone between the two conveyors. A further important advantage of the improved apparatus is that the control unit 2 (or an analogous or equivalent control unit) is surprisingly simple, compact and inexpensive, as well as that removal of samples does not necessitate the provision of a discrete suction drum or the like. In other words, the means for removing samples is actually one of the conveyors which define the normal path for the transport of rod-shaped articles from a preceding station to the next-following station. This contributes to simplicity and lower cost of the apparatus as well as to its compactness so that the apparatus can be readily installed in existing machines for the production and/or processing of plain or filter cigarettes, cigars, cigarillos, filter rod sections or the like. Moreover, and as already pointed out above, the speed at which the articles are transported is of no consequence because selected suction ports of the two conveyors can be connected to or sealed from the suction generating device 19 well ahead of the time when the samples to be removed reach the transfer zone 17. Such connection or disconnection can take place without in any way affecting the transport of the bulk of rod-shaped articles along their normal path. The means for ensuring the removal of samples at regular or irregular intervals do not interfere with normal operation of the apparatus, i.e., with the transport of articles from the conveyor 16 to the conveyor which receives articles from the conveyor 4, when the apparatus is not intended to remove samples and to deliver such samples into the container 48 at the removing location 22.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for transporting a layer of at least substantially parallel rod-shaped articles, such as cigarettes, substantially at right angles to the axes of the articles, comprising first and second conveyors movable in predetermined directions, defining a transfer zone and respectively having first and second patterns of article-attracting suction ports which share the movements of the respective conveyors, said conveyors further defining an elongated path having first and second sections respectively provided on said first and second conveyors and respectively having first and second article-receiving ends respectively located upstream of and in said transfer zone, said second conveyor further having at least one additional suction port provided in a predetermined portion thereof and sharing the movements of said second conveyor and said second pattern being interrupted in said portion of said second conveyor, said at least one additional port being located at least in part at a lateral position different from that of the ports in said second pattern; and control means operative to connect or disconnect selected suction ports with and from said suction generating means, the articles being transported from said first into said second path section when the ports of said first and second patterns and said at least one additional port are connected with said suction generating means during travel along the corresponding path sections, only the articles which are carried by said first conveyor and which register with said interrupted portion of said second conveyor in said transfer zone will remain on said first conveyor downstream of said transfer zone when the ports of said patterns are connected with but said at least one additional port is disconnected from said suction generating means, at least during travel of said at least one additional port in said transfer zone, said control means including means for connecting said at least one additional port with or for disconnecting said at least one additional port from said suction generating means independently of said patterns of suction ports.

2. The apparatus of claim 1, wherein said first conveyor includes a predetermined portion having additional suction port means arranged to attract said remaining articles, at least during travel of remaining articles with said first conveyor in said transfer zone.

3. The apparatus of claim 2, wherein said conveyors are endless conveyors which are respectively arranged to circulate about first and second axes, said at least one additional port of said second conveyor and said additional port means of said first conveyor being staggered with reference to the corresponding patterns of ports, as considered in the axial direction of the respective conveyors.

4. The apparatus of claim 3, wherein said conveyors have endless article-supporting peripheral surfaces and said ports and port means are provided in the peripheral surfaces of the respective conveyors.

5. The apparatus of claim 3, wherein each of said patterns includes several at least substantially parallel rows of suction ports, said rows being disposed in planes which are at least substantially normal to the axes of the respective conveyors.

6. The apparatus of claim 5, wherein said additional port means is disposed between two rows of suction ports in said first conveyor and said at least one additional port is disposed between two rows of suction ports in said second conveyor and is staggered with reference to the ports of such rows, as considered in the direction of movement of said second conveyor.

7. The apparatus of claim 6, wherein said additional port means includes a plurality of first suction ports and said second conveyor has a plurality of additional suction ports whose number matches that of said first suction ports.

8. The apparatus of claim 3, wherein said control means comprises a valving element adjacent said first conveyor and having at least one first slot extending along said first path section toward and at least close to said transfer zone and communicating with said suction generating means as well as with the ports of said first pattern during travel of such ports along said first path section, said connecting means including a second slot extending along and beyond said transfer zone and registering with said additional port means while such port means advances along and beyond said transfer zone, said control means further comprising means for selectively establishing and terminating a communication between said suction generating means and said second slot.

9. The apparatus of claim 8, wherein said first and second slots overlap each other, as considered in the direction of movement of said first conveyor, upstream of said transfer zone.

10. The apparatus of claim 8, wherein said second slot has an end portion located downstream of said transfer zone but upstream of the article-receiving end of said first path section, as considered in the direction of movement of said first conveyor, and further comprising receiving means adjacent the end portion of said second slot and arranged to accept articles which advance with said first conveyor beyond said transfer zone.

11. The apparatus of claim 8, wherein said valving element has at least one aerating opening disposed downstream of said transfer zone and communicating with the atmosphere as well as with the ports of said first pattern while such ports advance beyond said transfer zone.

12. The apparatus of claim 3, wherein said control means comprises a valving element adjacent said second conveyor and having first slot means in communication with said suction generating means and in register with the ports of said second pattern in said second path section and in said transfer zone, second slot means adjacent said second path section and communicating with said suction generating means as well as with said at least one additional suction port during travel of such port along said second path section, said connecting means including third slot means disposed in said transfer zone and communicating with said at least one additional suction port during travel of such port in said transfer zone, said control means further comprising means for selectively establishing and terminating a communication between said suction generating means and said third slot means.

13. The apparatus of claim 11, wherein said second pattern includes first and second rows of ports and such rows are respectively disposed in first and second planes which are at least substantially normal to the axis of said second conveyor, said first slot means including first and second slots in register with the suction ports of the respective rows.

14. The apparatus of claim 11, wherein said first and second slot means together constitute a composite slot which is connected with said suction generating means.

15. The apparatus of claim 3, wherein said control means comprises regulating means which is actuatable for the application of suction to said additional port means and for coordinated termination of the application of suction to said at least one additional port in dependency on the angular positions of said conveyors.

16. The apparatus of claim 15, wherein said control means further includes first and second valving elements respectively adjacent said first and second conveyors, said first valving element having first slot means communicating with said additional port means at and downstream of said transfer zone, as considered in the direction of movement of said first conveyor, said second valving element forming part of said connecting means and having second slot means communicating with said at least one additional port in said transfer zone and said regulating means including means for effecting the establishment and termination of connections between said suction generating means and said slot means.

17. The apparatus of claim 15, wherein said regulating means includes signal generating means for monitoring the angular positions of said conveyors.

18. The apparatus of claim 17, wherein said regulating means further comprises means for processing the signals which are generated by said monitoring means and for generating additional signals which initiate the application and termination of the application of suction to said additional port means and said at least one additional port.

19. The apparatus of claim 15, further comprising means for activating said regulating means.

20. The apparatus of claim 1, wherein said conveyors are rotary drum-shaped conveyors having axially parallel peripheral article-receiving flutes and said ports communicate with the flutes of said conveyors.

21. The apparatus of claim 12, wherein the orientation of said at least one additional suction port deviates from that of the ports of said second pattern.

22. The apparatus of claim 21, wherein said third slot is disposed in a plane which is at least substantially normal to the axis of said second conveyor and said at least one additional port is inclined with reference to such plane.

23. The apparatus of claim 22, wherein said second conveyor has at least two mutually inclined additional ports disposed at the opposite sides of said plane and merging into one another to communicate with said third slot during each circulation of said second conveyor.

* * * * *